US007853395B2

(12) United States Patent
Guo et al.

(10) Patent No.: US 7,853,395 B2
(45) Date of Patent: Dec. 14, 2010

(54) APPARATUS, SYSTEM, AND METHOD FOR CALIBRATING AN INTERNAL COMBUSTION ENGINE

(75) Inventors: Linsong Guo, Columbus, IN (US); Indranil Brahma, Bloomington, IN (US)

(73) Assignee: Cummins IP, Inc., Minneapolis, MN (US)

( * ) Notice: Subject to any disclaimer, the term of this patent is extended or adjusted under 35 U.S.C. 154(b) by 220 days.

(21) Appl. No.: 12/130,658

(22) Filed: May 30, 2008

(65) Prior Publication Data

US 2009/0299600 A1 Dec. 3, 2009

(51) Int. Cl.
*F02D 45/00* (2006.01)

(52) U.S. Cl. ..... 701/102; 701/114

(58) Field of Classification Search ..... 701/51, 701/53, 54, 101–105, 107, 110, 111, 114, 701/115; 702/182, 183, 186; 123/299, 300, 123/305

See application file for complete search history.

(56) References Cited

U.S. PATENT DOCUMENTS 6,304,812 B1 * 10/2001 Kolmanovsky et al. ..... 701/103
6,566,840 B1 5/2003 Wu et al.
7,047,125 B1 5/2006 He et al.
7,380,445 B2 * 6/2008 Wood ..... 73/114.39
7,467,033 B2 * 12/2008 Miller et al. ..... 701/22
2002/0152987 A1 * 10/2002 Woolford et al. ..... 123/333
2005/0056265 A1 * 3/2005 Center ..... 123/681
2005/0187700 A1 8/2005 Jacobson
2006/0260585 A1 * 11/2006 Munshi et al. ..... 123/299
2007/0156363 A1 7/2007 Stewart et al.
2008/0156084 A1 * 7/2008 Keski-Hynnila et al. . 73/114.69
2008/0264036 A1 * 10/2008 Bellovary ..... 60/274

OTHER PUBLICATIONS

PCT/US2009/045848, International Search Report and Written Opinion, Dec. 14, 2009.

* cited by examiner

*Primary Examiner*—Stephen K Cronin
*Assistant Examiner*—Johnny H Hoang
(74) *Attorney, Agent, or Firm*—Kunzler Needham Massey & Thorpe

(57) ABSTRACT

An apparatus that includes a calibration module, a conditions module, and an output module. The calibration module includes a plurality of calibration tables that includes a top-rated torque curve and bottom-rated torque curve for each of a plurality of predetermined engine operating modes of an engine emissions family. The top-rated torque curve corresponds to a top horsepower rating of the engine emissions family and the bottom-rated torque curve corresponds to a bottom horsepower rating of the engine emissions family. The conditions module is configured to determine operating conditions of the internal combustion engine. The output module is configured to command at least one component of the engine to achieve a desired engine output exhaust gas emissions value based at least partially on the operating conditions of the internal combustion engine and a comparison between the top horsepower rating and bottom horsepower rating of the engine emissions family.

20 Claims, 5 Drawing Sheets

400

Engine speed (rpm)

Engine torque (ft-lb)

| | 600 to 700 | 700 to 800 | 800 to 900 | 900 to 1000 | 1000 to 1100 | 1100 to 1200 | 1200 to 1300 | 1300 to 1400 | 1400 to 1500 | 1500 to 1600 | 1600 to 1700 | 1700 to 1800 | 1800 to 1900 | 1900 to 2000 | 2000 to 2100 | 2100 to 2200 |
|---|---|---|---|---|---|---|---|---|---|---|---|---|---|---|---|---|
| 1750 to 1800 | 0.00 | 0.00 | 0.00 | 0.00 | 0.00 | 0.00 | 0.00 | 0.08 | 0.08 | 0.33 | 0.00 | 0.00 | 0.00 | 0.00 | 0.00 | 0.00 |
| 1700 to 1750 | 0.00 | 0.00 | 0.00 | 0.00 | 0.00 | 0.00 | 0.00 | 0.00 | 0.00 | 0.16 | 0.49 | 0.16 | 0.08 | 0.00 | 0.00 | 0.00 |
| 1650 to 1700 | 0.00 | 0.00 | 0.00 | 0.00 | 0.00 | 0.00 | 0.00 | 0.00 | 0.00 | 0.16 | 0.00 | 0.25 | 0.33 | 0.00 | 0.00 | 0.00 |
| 1600 to 1650 | 0.00 | 0.00 | 0.00 | 0.00 | 0.00 | 0.00 | 0.00 | 0.00 | 0.00 | 0.00 | 0.00 | 0.08 | 0.25 | 0.08 | 0.00 | 0.00 |
| 1550 to 1600 | 0.00 | 0.00 | 0.00 | 0.00 | 0.00 | 0.00 | 0.00 | 0.08 | 0.00 | 0.00 | 0.00 | 0.00 | 0.00 | 0.16 | 0.00 | 0.00 |
| 1500 to 1550 | 0.00 | 0.00 | 0.00 | 0.00 | 0.00 | 0.00 | 0.00 | 0.00 | 0.00 | 0.16 | 0.08 | 0.00 | 0.08 | 0.16 | 0.00 | 0.00 |
| 1450 to 1500 | 0.00 | 0.00 | 0.00 | 0.00 | 0.00 | 0.00 | 0.00 | 0.00 | 0.16 | 0.00 | 0.08 | 0.08 | 0.00 | 0.00 | 0.00 | 0.00 |
| 1400 to 1450 | 0.00 | 0.00 | 0.00 | 0.00 | 0.00 | 0.00 | 0.00 | 0.00 | 0.00 | 0.00 | 0.08 | 0.08 | 0.08 | 0.00 | 0.00 | 0.25 |
| 1350 to 1400 | 0.00 | 0.00 | 0.00 | 0.00 | 0.00 | 0.00 | 0.08 | 0.08 | 0.00 | 0.00 | 0.00 | 0.08 | 0.00 | 0.08 | 0.08 | 0.25 |
| 1300 to 1350 | 0.00 | 0.00 | 0.00 | 0.00 | 0.00 | 0.00 | 0.00 | 0.08 | 0.08 | 0.25 | 0.16 | 0.00 | 0.08 | 0.00 | 0.08 | 0.16 |
| 1250 to 1300 | 0.00 | 0.00 | 0.00 | 0.00 | 0.00 | 0.00 | 0.00 | 0.00 | 0.16 | 0.33 | 0.25 | 1.56 | 0.58 | 0.00 | 0.08 | 0.16 |
| 1200 to 1250 | 0.00 | 0.00 | 0.00 | 0.00 | 0.00 | 0.00 | 0.08 | 0.16 | 0.08 | 0.16 | 0.08 | 1.81 | 3.04 | 0.58 | 0.00 | 0.33 |
| 1150 to 1200 | 0.00 | 0.00 | 0.00 | 0.00 | 0.00 | 0.16 | 0.08 | 0.00 | 0.08 | 0.16 | 0.08 | 0.16 | 1.89 | 1.89 | 0.16 | 0.00 |
| 1100 to 1150 | 0.00 | 0.00 | 0.00 | 0.00 | 0.08 | 0.00 | 0.16 | 0.16 | 0.00 | 0.25 | 0.74 | 0.25 | 0.08 | 0.82 | 0.08 | 0.00 |
| 1050 to 1100 | 0.00 | 0.00 | 0.00 | 0.08 | 0.08 | 0.08 | 0.00 | 0.00 | 0.00 | 0.33 | 0.08 | 0.25 | 0.25 | 0.16 | 0.08 | 0.41 |
| 1000 to 1050 | 0.00 | 0.00 | 0.00 | 0.16 | 0.00 | 0.08 | 0.00 | 0.08 | 0.08 | 0.16 | 0.00 | 0.25 | 0.66 | 0.16 | 0.58 | 2.14 |
| 950 to 1000 | 0.00 | 0.00 | 0.00 | 0.00 | 0.00 | 0.00 | 0.16 | 0.08 | 0.16 | 0.08 | 0.25 | 0.16 | 0.49 | 0.16 | 0.08 | 0.16 |
| 900 to 950 | 0.00 | 0.00 | 0.00 | 0.00 | 0.08 | 0.08 | 0.08 | 0.00 | 0.08 | 0.08 | 0.16 | 0.41 | 0.49 | 0.16 | 0.41 | 0.82 |
| 850 to 900 | 0.00 | 0.00 | 0.00 | 0.00 | 0.08 | 0.08 | 0.00 | 0.08 | 0.08 | 0.33 | 0.41 | 0.49 | 0.90 | 0.00 | 0.08 | 0.82 |
| 800 to 850 | 0.00 | 0.00 | 0.00 | 0.08 | 0.00 | 0.08 | 0.08 | 0.16 | 0.16 | 0.41 | 0.41 | 0.33 | 0.66 | 0.25 | 0.25 | 0.82 |
| 750 to 800 | 0.00 | 0.00 | 0.00 | 0.08 | 0.00 | 0.08 | 0.08 | 0.08 | 0.00 | 0.16 | 0.25 | 0.41 | 0.58 | 0.00 | 0.00 | 0.74 |
| 700 to 750 | 0.00 | 0.00 | 0.08 | 0.16 | 0.00 | 0.08 | 0.00 | 0.08 | 0.08 | 0.33 | 0.33 | 0.08 | 1.31 | 0.00 | 0.08 | 0.74 |
| 650 to 700 | 0.00 | 0.00 | 0.00 | 0.00 | 0.25 | 0.08 | 0.41 | 0.25 | 0.00 | 0.08 | 0.74 | 0.16 | 0.82 | 0.08 | 0.00 | 0.90 |
| 600 to 650 | 0.00 | 0.00 | 0.08 | 0.00 | 0.08 | 0.08 | 0.08 | 0.00 | 0.08 | 0.00 | 0.33 | 0.33 | 0.82 | 0.16 | 0.08 | 0.99 |
| 550 to 600 | 0.00 | 0.08 | 0.00 | 0.08 | 0.08 | 0.00 | 0.08 | 0.08 | 0.08 | 0.16 | 0.16 | 0.16 | 0.74 | 0.16 | 0.33 | 1.07 |
| 500 to 550 | 0.00 | 0.00 | 0.00 | 0.08 | 0.25 | 0.33 | 0.25 | 0.16 | 0.08 | 0.00 | 0.66 | 0.58 | 1.82 | 0.00 | 0.00 | 0.66 |
| 450 to 500 | 0.00 | 0.00 | 0.00 | 0.16 | 0.25 | 0.00 | 0.08 | 0.00 | 0.08 | 0.08 | 0.25 | 0.16 | 1.81 | 0.00 | 0.00 | 0.82 |
| 400 to 450 | 0.00 | 0.08 | 0.25 | 0.08 | 0.08 | 0.16 | 0.08 | 0.16 | 0.00 | 0.25 | 0.41 | 0.16 | 2.22 | 0.00 | 0.00 | 0.58 |
| 350 to 400 | 0.00 | 0.00 | 0.41 | 0.16 | 0.25 | 0.08 | 0.08 | 0.16 | 0.00 | 0.08 | 0.58 | 0.49 | 2.22 | 0.00 | 0.00 | 0.90 |
| 300 to 350 | 0.00 | 0.16 | 0.08 | 0.25 | 0.25 | 0.00 | 0.08 | 0.16 | 0.00 | 0.00 | 0.33 | 0.33 | 1.23 | 0.00 | 0.00 | 0.08 |
| 250 to 300 | 0.00 | 0.00 | 0.41 | 0.16 | 0.25 | 0.16 | 0.00 | 0.00 | 0.00 | 0.16 | 0.00 | 0.16 | 1.23 | 0.00 | 0.00 | 0.49 |
| 200 to 250 | 0.08 | 0.41 | 0.08 | 0.33 | 0.08 | 0.00 | 0.16 | 0.08 | 0.00 | 0.08 | 0.08 | 0.74 | 0.58 | 0.00 | 0.00 | 0.08 |
| 150 to 200 | 0.25 | 0.08 | 0.41 | 0.08 | 0.08 | 0.00 | 0.00 | 0.00 | 0.00 | 0.16 | 0.25 | 0.33 | 0.33 | 0.00 | 0.00 | 0.90 |
| 100 to 150 | 0.33 | 0.66 | 0.16 | 0.25 | 0.00 | 0.08 | 0.00 | 1.15 | 0.00 | 0.08 | 0.08 | 0.41 | 1.64 | 0.00 | 0.00 | 0.58 |
| 50 to 100 | 1.64 | 0.33 | 0.41 | 0.16 | 0.00 | 0.08 | 0.00 | 1.64 | 0.25 | 0.00 | 0.16 | 0.08 | 0.00 | 0.00 | 0.00 | 0.00 |
| 0 to 50 | 3.70 | 0.00 | 0.08 | 0.33 | 0.33 | 0.25 | 0.08 | 0.08 | 0.00 | 0.33 | 0.08 | 0.41 | 0.16 | 0.08 | 0.08 | 0.00 |

Fig. 4

APPARATUS, SYSTEM, AND METHOD FOR CALIBRATING AN INTERNAL COMBUSTION ENGINE

FIELD

This disclosure relates to calibrating an internal combustion engine, and more particularly to calibrating internal combustion engines of different ratings within a single emissions family.

BACKGROUND

Conventionally, internal combustion engines are distinguished by the engine family within which they are categorized. Engine families differ from other engine families based on different emissions standards, fuel systems, turbocharger systems, etc. For example, the engine family can be an engine emissions family within which each engine is configured to achieve a particular emissions standard.

The engines within each engine family are commonly distinguished by the particular horsepower ratings of the engines. For example, one engine within an engine family may have the same standards, fuel system, and turbocharger system as another engine in the family, but may be configured to achieve a higher horsepower at predefined engine operating conditions than the other engine. A desired horsepower rating or output of an engine within a given engine family can be achieved by adjusting various properties of the engine, such as the air to fuel ratio, fuel injection strategy (e.g., fuel injection pressure, timing, quantity, etc.), exhaust gas recirculation strategy, etc.

Internal combustion engine developers and manufacturers commonly use a set of calibration tables containing predetermined data for calibrating the engines of a particular engine family based on the horsepower rating of the engines. For example, for an engine emissions family, the set of calibration tables contains calibration data for all horsepower ratings of the engines within the family. In other words, the calibration tables assist developers and manufacturers in configuring the engines within the engine emissions family to achieve the desired horsepower rating and the emissions requirements associated with the engine emissions family.

Although conventional calibration techniques are known to assist developers in manufacturing variably-rated engines within a given engine emissions family that achieve particular emissions standards, such techniques do not account for the fuel economy of the engines for all horsepower ratings within the emissions family. For example, some calibration tables of conventional calibration techniques do not reflect optimal fuel economy and emissions achievement across all horsepower ratings and operating conditions of engines within a given engine emissions family. Also, conventional calibration techniques employing one unique set of calibration tables for each horsepower rating within a single engine emissions family may increase the cost of engine development and manufacturing.

SUMMARY

The subject matter of the present application has been developed in response to the present state of the art, and in particular, in response to the problems and needs in the art that have not yet been fully solved by currently available engine calibration techniques. Accordingly, the subject matter of the present application has been developed to provide apparatus, systems, and methods for calibrating internal combustion engines that overcome at least some shortcomings of the prior art calibration techniques.

For example, according to one representative embodiment, an apparatus for calibrating an internal combustion engine having a predefined horsepower rating and categorized within a given engine emissions family includes a calibration module, condition module, and an output module. The calibration module includes a plurality of calibration tables that includes a top-rated torque curve and bottom-rated torque curve for each of a plurality of predetermined engine operating modes of the engine emissions family. The top-rated torque curve corresponds to a top horsepower rating of the engine emissions family and the bottom-rated torque curve corresponds to a bottom horsepower rating of the engine emissions family. The condition module is configured to determine operating conditions of the internal combustion engine. The output module is configured to command at least one component of the engine to achieve a desired engine output exhaust gas emissions value based at least partially on the operating conditions of the internal combustion engine and a comparison between the predefined top horsepower rating and bottom horsepower rating of the engine emissions family.

In some implementations, the engine operating modes include a respective standard emissions testing mode. Each standard emissions testing mode can include an upper operating point corresponding to the top horsepower rating of the engine emissions family and a lower operating point corresponding to the bottom horsepower rating of the engine emissions family. According to one implementation of the apparatus, the engine operating modes also include some key points corresponding to an engine operating time percentage above a predetermined threshold.

In certain implementations, the at least one component includes fuel injectors, a variable geometry turbocharger, a fuel pressure regulating valve, and/or an exhaust gas recirculation valve.

In some implementations of the apparatus, an engine exhaust gas emissions surface between the top horsepower rating and bottom horsepower rating inclusive is uniform for each predetermined engine operating mode.

Each of the plurality of predetermined engine operating modes can include an upper mode corresponding to the top horsepower rating of the engine emissions family and a lower mode corresponding to the bottom horsepower rating of the engine emissions family. The plurality of calibration tables can include predetermined operating parameters for achieving a minimum brake specific fuel consumption at the upper and lower modes of each of the plurality of predetermined engine operating modes.

In some instances, an engine exhaust gas emissions surface between the top horsepower rating and bottom horsepower rating of at least one of the plurality of predetermined engine operating modes is non-uniform. For such instances, the calibration module is configured to determine a minimum brake specific fuel consumption between the upper and lower modes of each of the plurality of predetermined engine operating modes based at least partially on a fuel economy weighting factor.

The predefined horsepower rating is any of a plurality of intermediate horsepower ratings between the top horsepower rating and the bottom horsepower rating and the at least one component command is determined at least in part by using interpolation methods.

According to another embodiment, a method for calibrating an internal combustion engine includes determining an engine emissions family of the internal combustion engine.

The method also includes determining key operating modes of the internal combustion engine from calibration tables corresponding to the determined engine emissions family. The method includes determining whether a uniform emissions surface is achievable between the upper and lower horsepower rating points of each key operating mode and determining an engine horsepower rating of the internal combustion engine. Additionally, the method includes determining an optimal fuel economy for the determined horsepower ratings at each of the determined key operating modes. The optimal fuel economy is based at least partially on the determined horsepower rating of the internal combustion engine. The method further includes configuring the internal combustion engine according to the determined optimal fuel economy and a desired emissions surface at each of the determined key operating modes.

In certain implementations, if a uniform emissions surface is achievable between the upper and lower horsepower rating points of each key operating mode, the method further includes determining an optimal fuel economy at each key operating mode for the upper and lower horsepower ratings. In such implementations, the optimal fuel economy for the determined horsepower rating is based on the optimal fuel economy of the key operating modes for each horsepower rating. The optimal fuel economy for the determined horsepower rating at each of the determined key operating modes can be dependent on a fuel injection strategy and the relative configurations of a variable geometry turbocharger device, a fuel pressure regulating valve, and an exhaust gas recirculation valve.

In certain other implementations, if a uniform emissions surface is not achievable between the upper and lower horsepower rating points of each key operating mode, the method includes determining whether a maximum difference between an exhaust gas emissions value at any one horsepower rating of the engine emissions family and an exhaust gas emissions value at any other horsepower rating of the engine emissions family is greater than an emissions variation threshold. If the maximum difference is less than or equal to the emissions variation threshold, the optimal fuel economy for the determined horsepower rating at each of the determined key operating modes is determined using a first model. If, however, the maximum difference is greater than the emissions variation threshold, the optimal fuel economy for the determined horsepower rating at each of the determined key operating modes is determined using a second model different than the first model.

According to specific implementations, the first model includes Equation 1 below. The weighting factors determined in Equation 1 can be constrained according to Equations 2 and 3 below. The second model can include determining a minimum composite brake specific fuel consumption as a function of at least one of fuel injection timing and dosage, exhaust gas recirculation fraction, fuel injection rail pressure, and position of variable geometry turbo device for each operating point of interest within each key operating mode.

The key operating modes of the method can include a plurality of predetermined emissions testing modes. Also, or alternatively, the key operating modes can each include an engine operating mode having an operating time percentage above a predetermined operating time percentage threshold over duty cycles.

According to yet another embodiment, an engine calibration module for calibrating an internal combustion engine includes at least one set of calibration tables. The at least one set of calibration tables can include upper horsepower rating and lower horsepower rating information for each of a plurality of engine operating modes of a given engine emissions family. Further, the at least one set of calibration tables can include exhaust gas emissions surface information corresponding to the upper horsepower rating and lower horsepower rating information for each of the plurality of engine operating modes of the given engine emissions family. The at least one set of calibration tables also includes fuel economy optimization information corresponding to the upper horsepower rating and lower horsepower rating information for each of the plurality of engine operating modes of the given engine emissions family. Additionally, the at least one set of calibration tables includes engine component configuration information corresponding to the upper horsepower rating and lower horsepower rating information for each of the plurality of engine operating modes of the given engine emissions family. The engine component configuration information represents engine component configurations for achieving desired exhaust gas emissions surfaces represented by the exhaust gas emissions surface information and optimized fuel economy represented by the fuel economy optimization information. An internal combustion engine of the given engine emission family having any horsepower ratings between and including the upper and lower horsepower ratings is calibratable to achieve a desired exhaust gas emissions surface and an optimized fuel economy by accessing the at least one set of calibration tables.

In some implementations, the engine component configurations each include at least one of a desired timing and dosing of a main fuel injection, a desired timing and dosing of at least one post-injection, a desired exhaust gas recirculation fraction, a desired fuel injection rail pressure, a desired variable geometry turbocharger device position, and a desired timing and dosing of a pilot fuel injection.

According to certain implementations, the fuel economy optimization information includes a first set of fuel economy optimization information associated with uniform exhaust gas emissions surfaces for each of the plurality of engine operating modes and a second set of fuel economy optimization information associated with non-uniform exhaust gas emissions surfaces for at least one of the plurality of engine operating modes.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which:

FIG. 4 is a graph showing operating usage percentages for various engine speed and output torque combinations during transient operating conditions of the engine according to one embodiment.

DETAILED DESCRIPTION

Figure 1:
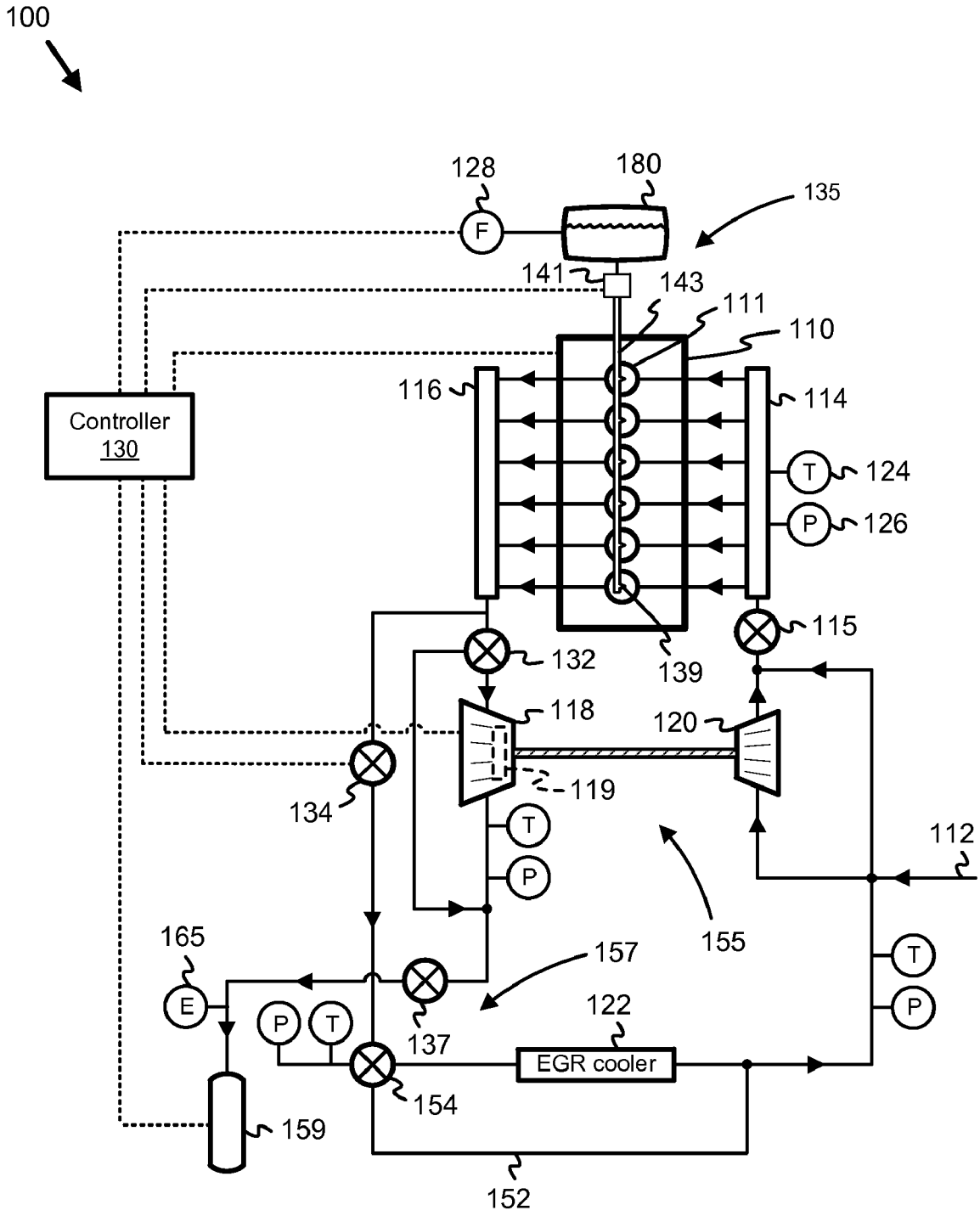
FIG. 1 is a schematic diagram of an engine system according to one embodiment.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the subject matter described herein may be combined in any suitable manner in one or more embodiments. In the following description, numerous specific details are provided, such as examples of controls, structures, algorithms, programming, software modules, user selections, network transactions, database queries, database structures, hardware modules, hardware circuits, hardware chips, etc., to provide a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

FIG. 1 depicts one exemplary embodiment of an internal combustion engine system, such as a diesel engine system 100, in accordance with the present invention. As illustrated, the engine system 100 includes a diesel engine 110, a controller 130, a fuel delivery system 135, a turbocharger system 155, an exhaust gas recirculation (EGR) system 157, and an exhaust gas aftertreatment system 159.

The engine 110 includes an air inlet 112, intake manifold 114, and exhaust manifold 116. The air inlet 112 is vented to the atmosphere, enabling air to enter the engine 110. The air inlet 112 is connected to an inlet of the intake manifold 114. The intake manifold 114 includes an outlet operatively coupled to combustion chambers 111 of the engine 110. The air from the atmosphere is combined with fuel to power, or otherwise, operate the engine 110. Combustion of the fuel produces exhaust gas that is operatively vented to the exhaust manifold 116.

The fuel is delivered into the combustion chambers 111 by the fuel delivery system 135. The fuel delivery system 135 includes a fuel tank 180 for storing the fuel and a fuel pump (not shown) for delivery the fuel to a common rail 143. The common rail 143 contains the fuel prior to being injected into the combustion chambers. From the common rail 143, the fuel is injected into combustion chambers 111 through one of several fuel injectors 139. The timing and dosage of fuel into the combustion chambers 111 is controlled by the controller 130 via electronic communication lines (shown as dashed lines in FIG. 1). In certain implementations, the pressure of the fuel in the common rail 143 is maintained at a desired fuel pressure. The fuel pressure in the rail can be modulated via actuation of a pressure relief valve 141 coupled to the inlet of the rail.

The quantity of air entering the intake manifold 114 and thus the combustion chambers 111 is regulated by an intake throttle 115 operatively coupled to an accelerator pedal (not shown). The position of the intake throttle 115 and the quantity of air entering the intake manifold 114 corresponds at least partially to the position of the accelerator pedal. The intake throttle 115 also is in electrical communication with the controller 130 and controllable by the controller. The controller 130 is operable to regulate the quantity of air entering the intake manifold 114 independent of the position of the accelerator pedal.

From the exhaust manifold 116, the exhaust gas flows into at least one of three systems, i.e., the turbocharger system 155, the EGR system 157, and the exhaust gas aftertreatment system 159. For example, based at least partially on the operating conditions of the engine, a portion of the exhaust gas can be directed into the turbocharger system 155, a portion of the exhaust gas can be directed into the EGR system 157, and a portion of the exhaust gas can be directed into the exhaust aftertreatment system 159. The relative portions of exhaust gas entering the respective systems 155, 157, 159 are controlled by the controller 130. Generally, the controller 130 determines the relative portions of exhaust gas that should enter the respective systems and commands valves, e.g., valves 132, 134, to allow a portion of the exhaust corresponding to the determined portions to enter the respective systems.

The turbocharger system 155 includes a turbocharger turbine 118, turbocharger compressor 120, and the turbocharger bypass valve 132. The turbocharger bypass valve 132 is selectively operable to regulate the flow of exhaust gas into the turbocharger turbine 118. The exhaust gas entering the turbine 118 causes the turbine to drive the compressor 120. When driven by the turbine 118, the compressor 120 compresses engine intake air before directing it to the intake manifold 114.

In certain implementations, the turbocharger turbine 118 is a variable geometry turbine (VGT) having a VGT device 119 such as is commonly known in the art. The VGT device 119 can be a series of movable vanes for controlling the flow of exhaust hitting the blades of the turbine. For example, at low engine speeds, the exhaust velocity is insufficient to effectively spin the turbine. Accordingly, at low engine speeds, the vanes can be moved into a relatively closed position such that the spaces between the vanes are relatively small. As the exhaust passes through the small spaces, it accelerates and is redirected to contact the turbine blades at a specific angle for optimum or fully enhanced rotation of the blades. In contrast, at high engine speeds, the exhaust velocity is sufficient to effectively spin the turbine. Accordingly, at high engine speeds, the vanes can be moved into a relatively open position such that the spaces between the vanes are relatively large. As the exhaust passes through the large spaces, its velocity remains relatively constant and experiences minimal redirection such that the blades of the turbine experience a less enhanced rotation. The positions of the vanes are adjusted via an actuator in electrical communication with the controller 130 such that the controller 130 can control the positions of the vanes.

The EGR system 157 includes an EGR cooler 122, an EGR valve 134, and an EGR cooler bypass valve 154. The EGR valve 134 is selectively controlled by the controller 130 to regulate the flow of exhaust entering the EGR system 157 from the exhaust manifold, and thus indirectly regulating the flow of exhaust entering the aftertreatment system 159. When the EGR valve 134 is at least partially open, at least a portion of the engine exhaust enters the EGR system 157 and is re-circulated into the combustion chambers 111 of the engine 110 to be combusted with air from the air intake 112. The portion of EGR gas entering the combustion chamber relative to the fresh air intake is defined as the EGR fraction. Prior to entering the combustion chambers 111, the EGR exhaust gas can be passed through the EGR cooler 122 to cool the exhaust gas in order to facilitate increased engine air inlet density. The EGR cooler bypass valve 154 is operatively controlled by the controller 130 to regulate the amount of EGR exhaust passing through the EGR cooler 122 and the amount of EGR exhaust gas bypassing the EGR cooler 122 via an EGR bypass line 152.

In addition to the VGT device 119 and the EGR valve 134, the flow rate of exhaust entering the exhaust aftertreatment system 159 can be regulated by an exhaust throttle 137 positioned within the exhaust stream between the aftertreatment system 159 and the turbocharger system 155. Like the VGT device 119, the exhaust throttle 137 is actuatable between a closed position and an open position. The closed position corresponds with a minimum space through which exhaust gas can pass and the open position corresponds with a maximum space through which exhaust gas can pass. As the space through which the exhaust flows is reduced, the flow rate of the exhaust is reduced. Therefore, as the exhaust throttle 137 moves from the open position to the closed position, the flow rate of exhaust entering the aftertreatment system 159 decreases. Similarly, as the exhaust throttle 137 moves from the closed position to the open position, the flow rate of exhaust entering the aftertreatment system 159 increases.

The valve positions of the VGT device 119 and exhaust throttle 137 affect the load on the engine and thus the temperature of the exhaust gas. For example, when the VGT device 119 is in a closed position, a backpressure is created in the exhaust manifold. In order to overcome the backpressure in the exhaust, the engine must increase its pumping work. The increased pumping work results in an increase in the engine output exhaust gas temperature. Similar to the VGT device 119, the more closed the exhaust throttle 137 valve position, the more backpressure created in the exhaust manifold, and the more pumping work performed by the engine. Accordingly, in certain instances, the temperature of the engine output exhaust can be increased by closing at least one of the VGT device 119 and exhaust throttle 137. For example, in some implementations, the VGT device 119 and exhaust throttle 137 can be controlled independent of each other to increase the engine output exhaust gas temperature. Alternatively, the VGT device 119 and exhaust throttle 137 can be dependently or cooperatively controlled to provide more precise control of the engine output exhaust temperature.

The exhaust aftertreatment system 159 reduces the number of pollutants in the exhaust gas prior to the gas entering the particulate filter. The exhaust aftertreatment system 159 can include any of various emissions reducing components known in the art, such as, for example, a diesel oxidation catalyst (DOC), a diesel particulate filter (DPF), a selective catalytic reduction (SCR) catalyst, and an ammonia oxidation catalyst (AMOX).

Various sensors, such as temperature sensors 124, pressure sensors 126, fuel sensor 128, exhaust gas flow sensors 165, and the like, may be strategically disposed throughout the engine system 100 and may be in communication with the controller 130 to monitor operating conditions. In one embodiment, the fuel sensor 128 senses the amount of fuel consumed by the engine, and the exhaust gas flow sensor 165 senses the rate at which exhaust gas is flowing at the particulate filter 150.

Engine operating conditions can be ascertained from any of the sensors or from the controller 130's commands to the engine regarding the fraction of exhaust gas recirculation, injection timing, and the like. In one embodiment, information is gathered regarding, for example, fuel rate, engine speed, engine load, fuel injection timing (e.g., SOI, or start of injection), fraction of exhaust gas recirculation, driving conditions, exhaust flow rate, the amount of $O_2$ and $NO_2$ in the exhaust, exhaust gas pressure, etc.

The engine 110 will produce $NO_x$, particulate matter (e.g., soot and ash), and hydrocarbon (HC) emissions at a rate that varies according to the engine emissions family with which the engine 110 is associated. In other words, depending on the engine emissions family the engine 110 is configured to produce emissions at or below the particular emissions standards corresponding to the engine emissions family. The engine 110 is configured by controlling one or more operating parameters of the engine, such as the fuel injection strategy, EGR fraction, VGT device position, fuel injection common rail pressure, and main injection timing (SOI). Other factors may also bear on the particulate production rate, some depending heavily on the engine emissions family of the engine (e.g., an exhaust throttle, intake throttle, and EGR cooler bypass valve position) and others being platform-independent (e.g., environmental and external considerations).

Figure 2:
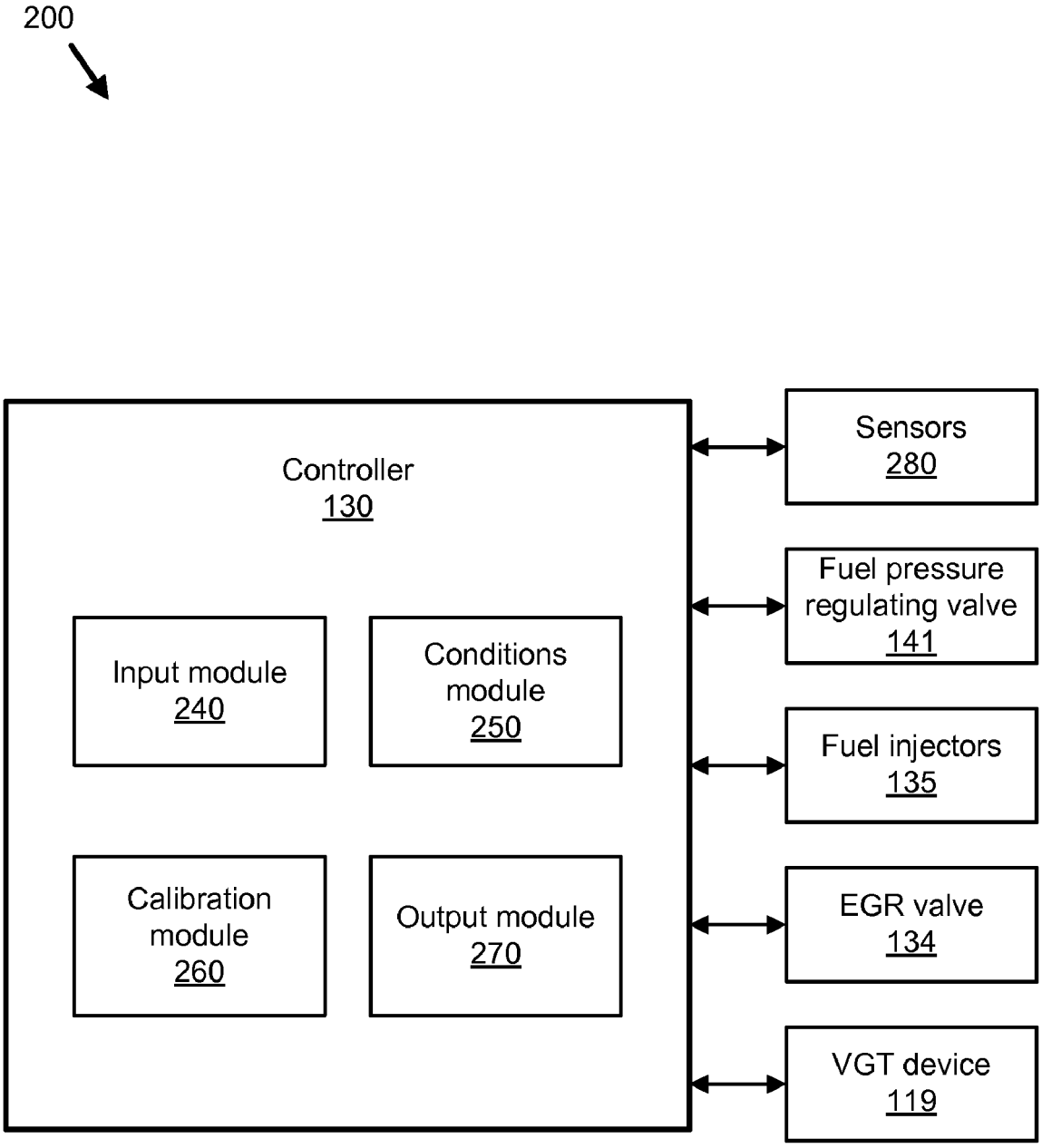
FIG. 2 is a schematic diagram of a controller of the engine system according to one embodiment.

FIG. 2 depicts a control system 200 according to one representative embodiment. The control system 200 comprises the controller 130, the VGT device 119, the EGR valve 134, the fuel pressure regulating valve 141, sensors 280 (e.g., sensors 124, 126, 128), and the fuel injectors 135. The controller 130 includes an input module 240, a conditions module 250, a calibration module 260, and an output module 270.

As is known in the art, the controller 130 and components may comprise processor, memory, and interface modules that may be fabricated of semiconductor gates on one or more semiconductor substrates. Each semiconductor substrate may be packaged in one or more semiconductor devices mounted on circuit cards. Connections between the modules may be through semiconductor metal layers, substrate-to-substrate wiring, or circuit card traces or wires connecting the semiconductor devices.

The sensors 280 are configured to determine a plurality of conditions within the engine system 100, including temperature, pressure, exhaust gas flow rate, etc. The input module 240 is configured to input the conditions sensed by the sensors 280 and provides corresponding inputs to the conditions module 250. The conditions module 250 is configured to gather information regarding current operating conditions of the engine system 100, based on the conditions sensed by the sensors 280 and/or other inputs including commands issued to system components by the controller 130.

The output module 270 is configured to direct the fuel injectors 135 to inject fuel into the compression chambers of the engine 110 according to a predetermined fuel injection strategy. The predetermined fuel injection strategy includes dosage and timing information for a main fuel injection, one or more post-injections, and a pilot fuel injection, such as described in U.S. patent application Ser. No. 12/111,831 (filed Apr. 29, 2008) and Ser. No. 12/111,845 (filed Apr. 29, 2008), which are incorporated herein by reference. The output module 270 also is configured to command the VGT device 119 into a predetermined VGT configuration. Further, the output module 270 is configured to command the fuel pressure regulating valve 141 into a predetermined position. Additionally, the output module 270 is configured to command the EGR valve 134 into a predetermined position.

The operating parameters of the engine, e.g., the predetermined fuel injection strategy, predetermined VGT configuration, predetermined position of the fuel pressure regulating valve 141, and predetermined position of the EGR valve 134, are obtained from a calibration module 260. The calibration module 260 includes predetermined calibration tables for each operating parameter controlled by the output module 270. For example, the calibration module 260 includes predetermined fuel injection calibration tables, a predetermined VGT calibration table, a predetermined fuel pressure calibration table, and a predetermined EGR calibration table.

Figure 3:
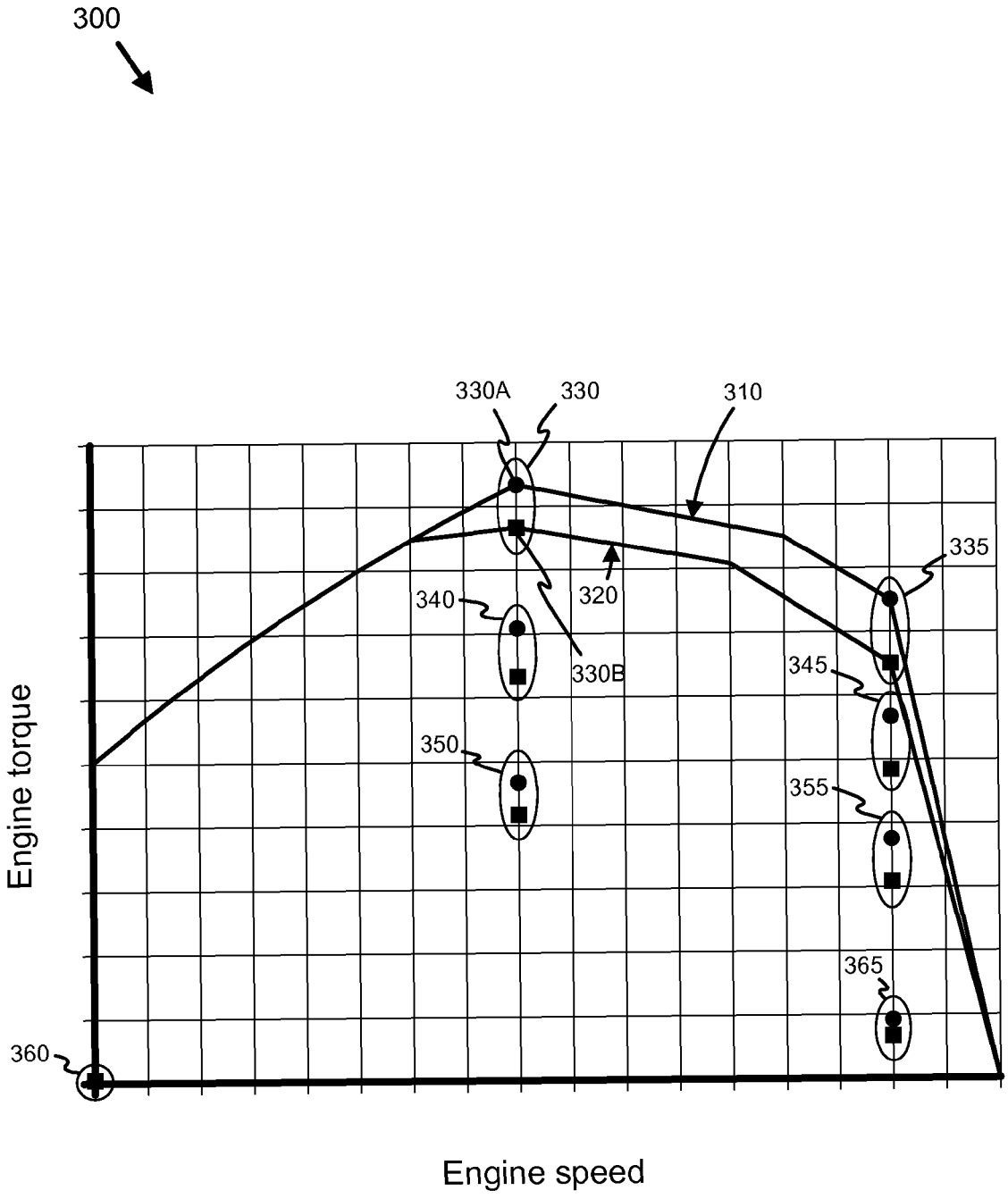
FIG. 3 is a graph comparing engine speed and output torque for various engine operating modes defined by a steady state emissions test according to one embodiment.

The operating parameter tables are dependent upon predetermined engine operating condition points of interest, such as shown in table 300 of FIG. 3. Table 300 includes various predetermined torque-speed data sets or curves (e.g., torque curves 310, 320) each obtained during steady state conditions of the engine. Each torque-speed data set shown in table 300 includes at least one standard emissions testing mode. The table 300 includes eight modes (e.g., modes 330, 335, 340, 345, 350, 355, 360, 365) typically tested in standard non-road steady-state emissions tests. Each mode 330, 335, 340, 345, 350, 355, 360, 365 is represented by a predefined speed-torque point associated with the maximum-rated (e.g., top-rated) and minimum-rated (e.g., bottom-rated) horsepower engines within the same engine emissions family being calibrated. Modes 330, 335, 340, 345, 350, 355, 360, 365 are associated with top-rated and bottom-rated engine torque curves 310, 320 that pass through the respective maximum-rated and minimum-rated speed-torque points of each mode. For example, mode 330, it being representative of modes 335, 340, 345, 350, 355, 360, 365, includes a maximum-rated speed-torque point 330A through which top-rated engine torque curve 310 passes and a minimum-rated speed-torque point 330B through which bottom-rated engine torque curve 320 passes. Although eight specific non-road steady-state emissions modes are shown, in other implementations, other steady-state emissions modes can be used depending on the particular emissions test being conducted. For example, thirteen modes are used for on-highway SET emissions tests.

The top-rated torque curve 310 represents a torque-speed curve for engines configured to achieve the maximum horsepower rating in a given engine emissions family. Similarly, the bottom-rated torque curve 320 represents torque-speed curve for engines configured to achieve the minimum horsepower rating in a given engine emissions family. As an example only, the top-rated torque curve 310 can correspond to the torque-speed values for an engine rated at 500 HP and the bottom-rated torque curve 320 can correspond to the torque-speed values for an engine rated at 350 HP. Emissions test modes for intermediate-rated horsepower ratings (e.g., horsepower ratings between the maximum and minimum horsepower rating) fall between the maximum-rated and minimum-rated horsepower ratings of the respective modes 330, 335, 340, 345, 350, 355, 360, 365.

According to one embodiment, two sets of calibration tables are developed with each set corresponding to a respective one of the top-rated and bottom-rated horsepower ratings. The calibration module 260 can be calibrated or tuned according to the two sets of calibration tables to achieve uniform engine system 100 output exhaust gas emissions below regulated upper emissions limits or design targets for the top-rated and bottom-rated torque curves 310, 320 associated with modes 330, 335, 340, 345, 350, 355, 360, 365 corresponding to the engine emissions family being calibrated. If uniform engine system 100 output exhaust emissions can be achieved below the regulated upper emissions limits or design targets for the top-rated and bottom-rated horsepower ratings for each mode, then uniform engine system output exhaust emissions below the regulated upper emissions limits or design targets can be achieved for horsepower ratings between the top-rated and bottom-rated horsepower ratings for each mode of the engine emissions family. Accordingly, a uniform exhaust gas emissions surface for an engine emissions family can be achieved, which means that the $NO_x$ signature is the same within the modes 330, 335, 340, 345, 350, 355, 360, 365 from the top horsepower rating to the bottom horsepower rating. As defined herein, a uniform exhaust gas emissions surface means engine system 100 output exhaust gas emissions (e.g., brake specific $NO_x$ ($BSNO_x$), PM, HC, etc.) values are equal between (and including) the top-rated and bottom-rated horsepower ratings for each mode of an engine emissions family.

If a uniform exhaust gas emissions surface can be achieved at each emissions mode, then the calibration module 260 determines the maximum fuel economy (e.g., minimum brake specific fuel consumption (BSFC)) achievable for each of the top-rated and bottom-rated horsepower ratings of each mode. The maximum fuel economy achievable for any intermediate-rated horsepower rating between the top-rated and bottom-rated horsepower ratings can be determined using common interpolation methods known in the art.

The fuel economy at each of the horsepower ratings of interest can be maximized because the BSFC and the amount of emissions generated are both a function of the fuel injection strategy, VGT position, fuel pressure regulating valve position, and EGR valve position. For example, the fuel injection strategy (e.g., timing and dosage of a pilot injection, a main injection, and one or more post-injections), VGT position, fuel pressure regulating valve position, and EGR valve position can be experimentally varied to determine the configurations resulting in the lowest BSFC while maintaining the exhaust emissions uniformity for the top-rated and bottom-rated horsepower ratings in the engine emissions family. Once the fuel injection strategy, VGT device, fuel pressure regulating valve, and EGR valve configurations for minimizing BSFC and maintaining emissions uniformity on the top-rated and bottom-rated horsepower ratings are determined, the configurations for minimizing BSFC and maintaining emissions uniformity of any intermediate-rated horsepower ratings can be determined using common interpolation methods known in the art.

In another embodiment, only one set of calibration tables is developed for both the top-rated and bottom-rated horsepower ratings. For each of the top-rated and bottom-rated torque curves 310, 320 associated with each mode 330, 335, 340, 345, 350, 355, 360, 365, the calibration module 260 is calibrated or tuned according to the set of calibration tables in such a way that uniform engine system 100 output exhaust gas emissions below the regulated upper emissions limit or design target for the engine emissions family is achievable. Similar to the two sets of calibration tables approach, if uniform exhaust gas emissions below the regulated limits or design targets can be achieved for the top-rated and bottom-rated horsepower ratings for each mode, then the exhaust gas emissions for any of the engine ratings between the top and bottom horsepower ratings can be below the regulated upper emissions limit or design target for the engine emissions family. If a uniform exhaust gas emissions surface can be achieved at each emissions mode by using only one set of calibration tables, then the calibration module 260 determines the maximum fuel economy achievable for a given horsepower rating for which optimization of BSFC is desired. The maximum fuel economy for another horsepower rating in an engine emissions family other than the given horsepower rating may be achievable by developing a different set of calibration tables. Generally, if only one set of calibration tables is used, the calibration tables are developed based on the best tradeoff between emissions limits and fuel economy for a specific rating, e.g., the top horsepower rating in a given emissions family.

The determined fuel injection strategy, VGT device, fuel pressure regulating valve, and EGR valve configurations for minimizing BSFC and maintaining emissions uniformity on the top-rated and bottom-rated horsepower ratings of an engine emissions family can be integrated into the table 300 of FIG. 3 or included in separate calibration tables. For example, the calibration module 260 can include a plurality of calibration tables each including the experimentally obtained configurations of a respective operating component. During operation of an engine, and based on the operating speed of the engine 110 determined from the conditions module 250 and the horsepower rating of the engine being operated, the calibration module 260 can determine the operating components configurations by accessing the respective calibration tables. After obtaining the operating parameters of the engine, e.g., predetermined fuel injection strategy, predetermined VGT configuration, the fuel pressure regulating valve predetermined position, and EGR valve predetermined position, and communicates the determined parameters to the output module 270. If the designated horsepower rating of the engine is between the maximum and minimum horsepower ratings for a given engine emissions family, then the calibration module 260 interpolates according to common interpolation techniques to obtain the operating parameter values for the intermediate-rated horsepower ratings. The output module 270 then commands the respective components of the engine system according to the obtained predetermined operating parameters.

Additionally, the determined fuel injection strategy, VGT device, fuel pressure regulating valve, and EGR valve configurations for minimizing BSFC and maintaining emissions uniformity on the top-rated and bottom-rated horsepower ratings of an engine emissions family can be used to calibrate any engine at any horsepower rating within the engine emissions family using common interpolation techniques known in the art.

In embodiments where a uniform emissions surface between (and including) top-rated and bottom-rated horsepower ratings for each respective emissions testing mode cannot be achieved by using only one set of calibration tables, then the minimization of the BSFC for the top-rated and bottom-rated horsepower ratings for each mode that is unable to achieve uniform emissions is achieved in a different manner. For example, in certain embodiments, the BSFC is minimized for a given operating mode by a weighting technique according to Equation 1 below or BSFC is minimized for a given point of interest within a given mode by determining the minimum BSFC at each operating point of interest as a function of engine operating parameters affecting fuel economy, such as, for example, dosage and timing of a main fuel injection and post-injections, the EGR fraction entering the engine, the position of the VGT device 119, and the fuel pressure within the fuel rail 143.

$$\min \sum BSFC = \sum_{i=1}^{h} W_i \times BSFC_i \tag{1}$$

$$\sum NO_x = \sum_{i=1}^{8} \mathrm{WF_r}_i \times NO_{x,i} \leq NO_{x,target} \tag{2}$$

$$\sum PM = \sum_{i=1}^{8} \mathrm{WF_r}_i \times PM_i \leq PM_{target} \tag{3}$$

In Equation 1, the weighting factor $W_i$ for each key point can be determined by ranking the importance of fuel economy for interested test modes, e.g., at rated and peak torque operating conditions of the top-rated horsepower rating or bottom-rated horsepower rating, any of various intermediate-rated horsepower ratings, or key points of duty cycles from real applications. The weighting factor $W_i$ may be assigned a larger value for rated and peak torque operating conditions (and key points of duty cycles) compared with other operating conditions because BSFC can be particularly important during rated and peak torque operating conditions, as well as key points of duty cycles. In Equations 2 and 3, $\mathrm{WF_r}_i$ is the weighting factor at a respective one of the eight emissions modes of FIG. 3. The weighting factor $\mathrm{WF_r}_i$ determines the emissions contribution of each mode to the composite emissions. Accordingly, $NO_{x,i}$ and $PM_i$ are the emissions levels of $NO_x$ and PM at a respective one of the eight emissions modes, and $NO_{x,target}$ and $PM_{target}$ are equal to predetermined upper limits for composite $NO_x$ and PM emissions, respectively. Therefore, $\Sigma NO_x$ is the composite $NO_x$ over a certification cycle and ΣPM is the composite PM over the certification cycle.

Alternatively, in other embodiments, in addition to the emissions testing modes shown in FIG. 3, other key points can be included in Equation 1 for BSFC optimization or improvement, such as, e.g., duty cycle key points. Based at least partially on the applications for each engine horsepower rating, each additional key point is determined for the top-rated horsepower rating, bottom-rated horsepower rating, or intermediate-rated horsepower ratings within a given emissions family. The weighting factor $W_i$ of the BSFC is individually determined for each key point (e.g., mode) of an engine with a selected engine horsepower rating based on the applications of the selected horsepower rating. The lowest composite BSFC defined by Equation 1 can be achieved for an engine emissions family by determining a desired fuel injection strategy, predetermined VGT configuration, the fuel pressure regulating valve predetermined position, and EGR valve predetermined position. The desired component configurations are normally defined through experimentation during performance development of the engine. The determination of the desired component configurations for achieving a minimum composite BSFC is constrained according to the mechanical limitations of the engine system 100 and the emissions design targets defined in Equations 2 and 3 above.

In some embodiments, one set of calibration tables is created to achieve uniform exhaust emissions and minimize BSFC for transient operating modes, such as defined by the Federal Test Procedure (FTP) for on-highway or the Non-Road Transient Cycle (NRTC) for off-highway, for all engine ratings within a given engine emissions family. For transient operating condition calibration tables, key points representing all engines within a given engine emissions family are defined based on the relative percentage of time spent on the points during operating of the engine. A representative table 400 displaying the percentage of time spent on all operating points of an engine is shown in FIG. 4. The operating points of the table 400 are defined by the speed range and torque range within which the points fall. A key point can be selected based on whether the percentage of operating time spent on the point is above a predetermined threshold. For example, in some instances, the key points can be any points having an operating time percentage above 0.1%.

Once the key points are determined, a fuel injection strategy, VGT device position, fuel pressure regulating valve position, and EGR valve position configurations for minimizing BSFC and maintaining emissions uniformity between and including the top-rated and bottom-rated horsepower ratings of an engine emissions family during transient operation can be obtained in the same manner as for steady state operation as described above. In other words, the key points are treated as emissions testing modes for the purpose of determining an engine components configuration during transient engine operation. The emissions correlations between these key points and transient cycles can be determined through steady state emissions testing and transient cycle testing. For example, the transient cycle emissions can be equal to the weighted composite emissions of the key points with the weighting factors being a function of the operating time percentage at each point, or conversion of steady state operation to transient operation using quasi steady state methods known in the art.

Figure 5:
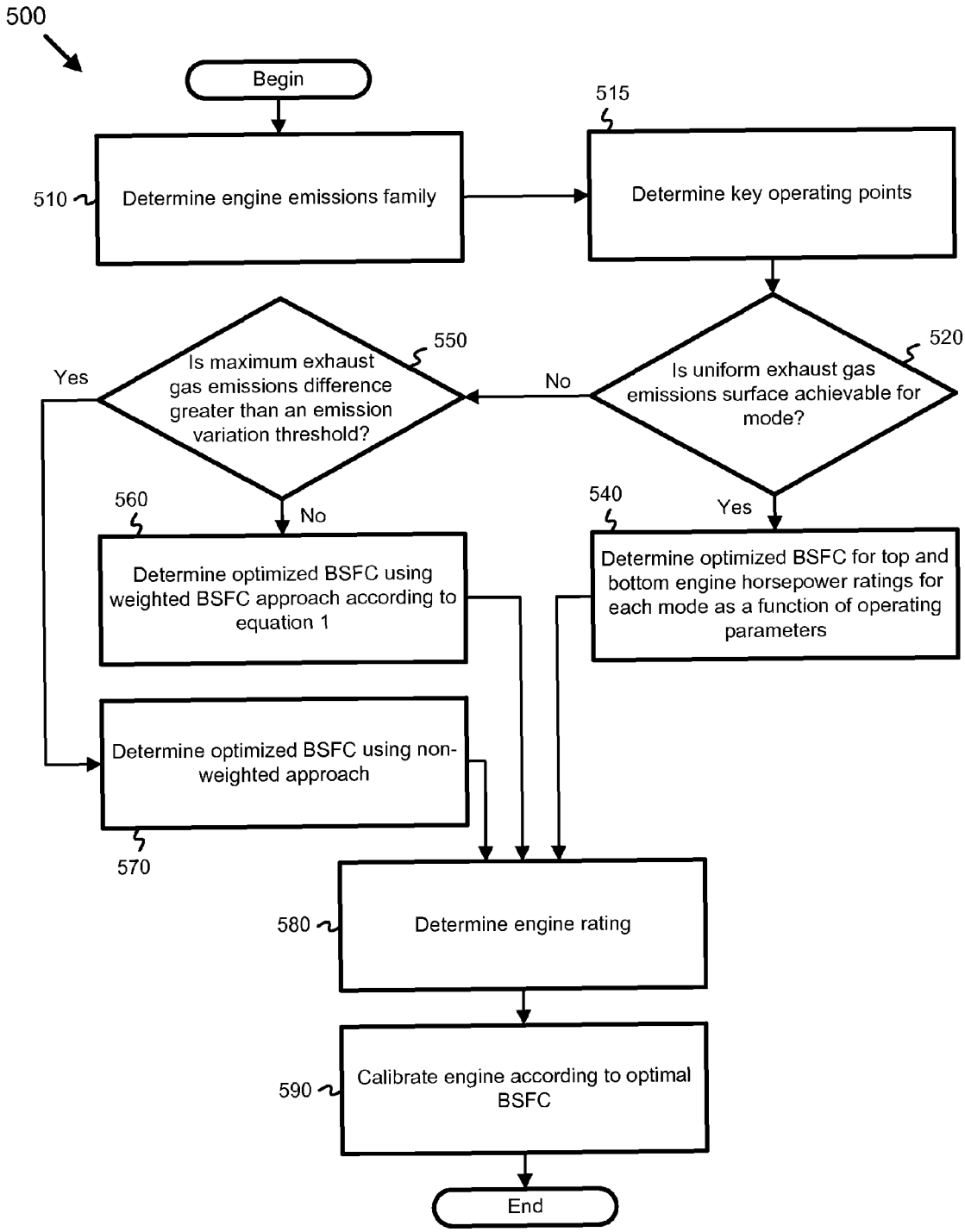
FIG. 5 is a method for calibrating an engine according to one embodiment.

According to one method 500 for calibrating an engine shown in FIG. 5, the engine emissions family within which the engine to be calibrated is categorized is determined at 510. The method 500 then determines 515 the key operating points for the engine emissions family determined at event 510. The method 500 proceeds to determine 520 (e.g., through experimentation) whether a uniform exhaust gas emissions surface is achievable for all engine ratings at each mode and/or key point or range of the engine emissions family operating range. If a uniform exhaust gas emissions surface is achievable, then the method determines 540 the optimized BSFC for top and bottom horsepower ratings for each mode and/or key point as a function of predefined engine operating parameters, e.g., fuel injection strategy, VGT configuration, fuel pressure regulating valve position, and EGR valve position. If a uniform exhaust gas emissions surface is not achievable, then the method proceeds to determine 550 whether a maximum difference in exhaust gas emissions between any two ratings within the engine emission family greater than an emissions variation threshold. The emissions variation threshold is the maximum tolerance of emissions differences of the ratings within a given engine emissions family.

If the maximum emissions difference is less than or equal to the emissions variation threshold as determined at event 550, the method determines 560 an optimized BSFC according to Equation 1, but constrained by Equations 2 and 3 for all ratings in the engine emissions family. However, if the maximum emissions difference is more than the emissions variation threshold as determined at event 550, the method 500 determines 570 an optimized BSFC at respective points of interest within the operating modes as a function of the predefined engine operating parameters. After determining the optimized BSFC for various key operating points of the engine at events 540, 560, or 570, the horsepower rating of the engine to be calibrated is determined at event 580 and the engine is calibrated at least partially according to the determined optimized BSFC for the key operating points. Calibration of the engine can include uploading the steady state and transient operating condition maps and/or tables, e.g., table 300, including the operating parameter configurations for achieving a desired emissions output and minimizing the BSFC, to the calibration module 260 of the engine. The engine 110 can be operated and the applicable components (e.g., VGT device 119, EGR valve 134, fuel injectors 135, and fuel pressure regulating valve 141) can be controlled according to the uploaded maps and/or tables.

The method 500 can be applied to calibrate the engine for steady state operation and transient operation of an engine. If the method 500 is being used to calibrate steady state operation of the engine, the key operating points determined at event 515 are combinations of steady state emissions testing modes, duty cycle key points, and other key points. However, if the method 500 is being used to calibrate transient operation of the engine, the key operating points determined at event 515 are key points based on the time percentage of engine operation over a transient cycle, e.g., see FIG. 4.

The schematic flow chart diagrams and method schematic diagrams described above are generally set forth as logical flow chart diagrams. As such, the depicted order and labeled steps are indicative of representative embodiments. Other steps and methods may be conceived that are equivalent in function, logic, or effect to one or more steps, or portions thereof, of the methods illustrated in the schematic diagrams. Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for calibrating an internal combustion engine having a predefined horsepower rating and categorized within an engine emissions family, comprising:

a calibration module comprising a plurality of calibration tables comprising a top-rated torque curve and bottom-rated torque curve for each of a plurality of predetermined engine operating modes of the engine emissions family, the top-rated torque curve corresponding to a top horsepower rating of the engine emissions family and the bottom-rated torque curve corresponding to a bottom horsepower rating of the engine emissions family;

a conditions module configured to determine operating conditions of the internal combustion engine; and an output module configured to command at least one component of the engine to achieve a desired engine output exhaust gas emissions value based at least partially on the operating conditions of the internal combustion engine and a comparison between the predefined horsepower rating and the top and bottom horsepower ratings of the engine emissions family;

wherein each of the plurality of predetermined engine operating modes comprises an upper mode corresponding to the top horsepower rating of the engine emissions family and a lower mode corresponding to the bottom horsepower rating of the engine emissions family; and wherein the plurality of calibration tables comprise predetermined operating parameters for achieving a minimum brake specific fuel consumption at the upper and lower modes of each of the plurality of predetermined engine operating modes.

2. The apparatus of claim 1, wherein the engine operating modes each comprise a respective standard emissions testing mode.

3. The apparatus of claim 2, wherein each standard emissions testing mode comprises an upper operating point corresponding to the top horsepower rating of the engine emissions family and a lower operating point corresponding to the bottom horsepower rating of the engine emissions family.

4. The apparatus of claim 1, wherein the engine operating modes each comprise a key point corresponding to an engine operating time percentage above a predetermined threshold.

5. The apparatus of claim 1, wherein the at least one component comprises an engine component selected from the group consisting of fuel injectors, a variable geometry turbocharger, a fuel pressure regulating valve, and an exhaust gas recirculation valve.

6. The apparatus of claim 1, wherein for each predetermined engine operating mode, an engine exhaust gas emissions surface between the top horsepower rating and bottom horsepower rating inclusive is uniform.

7. The apparatus of claim 1, wherein:

an engine exhaust gas emissions surface between the top horsepower rating and bottom horsepower rating of at least one of the plurality of predetermined engine operating modes is non-uniform; and the calibration module is configured to determine a minimum brake specific fuel consumption at the upper and lower modes of each of the plurality of predetermined engine operating modes based at least partially on a fuel economy weighting factor.

8. The apparatus of claim 1, wherein:

the predefined horsepower rating is any of a plurality of intermediate horsepower ratings between the top horsepower rating and the bottom horsepower rating; and the at least one component command is determined at least in part by using interpolation methods.

9. A method for calibrating an internal combustion engine, comprising:

determining an engine emissions family of the internal combustion engine;

determining key operating modes of the internal combustion engine from calibration tables corresponding to the determined engine emissions family, each key operating mode comprising an upper horsepower rating point and a lower horsepower rating point;

determining whether a uniform emissions surface is achievable between the upper and lower horsepower rating points of each key operating mode;

determining an engine horsepower rating of the internal combustion engine;

determining an optimal fuel economy for the determined horsepower rating at each of the determined key operating modes, the optimal fuel economy being based at least partially on the determined horsepower rating of the internal combustion engine; and configuring the internal combustion engine according to the determined optimal fuel economy and a desired emissions surface at each of the determined key operating modes.

10. The method of claim 9, wherein:

if a uniform emissions surface is achievable between the upper and lower horsepower rating points of each key operating mode, the method further comprises determining an optimal fuel economy for the upper and lower horsepower ratings points of each key operating mode; and the optimal fuel economy for the determined horsepower rating is based on the optimal fuel economy for the upper and lower horsepower ratings of each key operating mode.

11. The method of claim 10, wherein the optimal fuel economy for the determined horsepower rating at each of the determined key operating modes is dependent on a fuel injection strategy and the relative configurations of a variable geometry turbocharger device, a fuel pressure regulating valve, and an exhaust gas recirculation valve.

12. The method of claim 9, wherein:

if a uniform emissions surface is not achievable between the upper and lower horsepower rating points of each key operating mode, the method comprises determining whether a maximum difference between an exhaust gas emissions value at any one horsepower rating of the engine emissions family and an exhaust gas emissions value at any other horsepower rating of the engine emissions family is greater than an emissions variation threshold;

if the maximum difference is less than or equal to the emissions variation threshold, the optimal fuel economy for the determined horsepower rating at each of the determined key operating modes is determined using a first model;

if the maximum difference is greater than the emissions variation threshold, the optimal fuel economy for the determined horsepower rating at each of the determined key operating modes is determined using a second model different than the first model.

13. The method of claim 12, wherein the first model comprises $$\min\sum BSFC = \sum_{i=1}^{h} W_i \times BSFC_i,$$

wherein min$\Sigma$BSFC is a minimum composite brake specific fuel consumption for the determined horsepower rating at a given key operating mode, $W_i$ is a fuel economy weighting factor, and h is equal to a predefined number of key operating modes.

14. The method of claim 13, wherein the first model is constrained according to $$\sum NO_x = \sum_{i=1}^{n} \mathrm{WF_r}_i \times NO_{x,i} \leq NO_{x,target} \text{ and } \sum PM = \sum_{i=1}^{n} \mathrm{WF_r}_i \times PM_i \leq PM_{target},$$

wherein $\Sigma NO_x$ is the composite nitrogen oxide ($NO_x$) over a certification cycle, $\Sigma$PM is the composite particulate matter (PM) over a certification cycle, $\mathrm{WF_r}_i$ is an emissions contribution weighting factor at a respective one of the emissions modes, $NO_{x,target}$ is a predetermined upper limit for composite $NO_x$ emissions, and $PM_{target}$ is a predetermined upper limit for composite PM emissions.

15. The method of claim 12, wherein the second model comprises determining a minimum composite brake specific fuel consumption as a function of at least one of fuel injection timing and dosage, exhaust gas recirculation fraction, fuel rail pressure, and position of variable geometry turbo device for each operating point of interest within each key operating mode.

16. The method of claim 9, wherein the key operating modes comprise a plurality of predetermined emissions testing modes.

17. The method of claim 9, wherein the key operating modes each comprise an engine operating mode having an operating time percentage above a predetermined operating time percentage threshold.

18. An engine calibration module for calibrating an internal combustion engine, comprising:

at least one set of calibration tables comprising:

upper horsepower rating and lower horsepower rating information for each of a plurality of engine operating modes of a given engine emissions family;

exhaust gas emissions surface information corresponding to the upper horsepower rating and lower horsepower rating information for each of the plurality of engine operating modes of the given engine emissions family;

fuel economy optimization information corresponding to the upper horsepower rating and lower horsepower rating information for each of the plurality of engine operating modes of the given engine emissions family; and engine component configuration information corresponding to the upper horsepower rating and lower horsepower rating information for each of the plurality of engine operating modes of the given engine emissions family, the engine component configuration information representing engine component configurations for achieving desired exhaust gas emissions surfaces represented by the exhaust gas emissions surface information and optimized fuel economy represented by the fuel economy optimization information;

wherein an internal combustion engine of the given engine emission family having any horsepower ratings between and including the upper and lower horsepower ratings is calibratable to achieve a desired exhaust gas emissions surface and an optimized fuel economy by accessing the at least one calibration table.

19. The engine calibration module of claim 18, wherein the engine component configurations each comprise at least one of a desired timing and dosing of a main fuel injection, a desired timing and dosing of at least one post-injection, a desired exhaust gas recirculation fraction, a desired fuel rail pressure, a desired variable geometry turbocharger device position, and a desired timing and dosing of a pilot fuel injection.

20. The engine calibration module of claim 18, wherein the fuel economy optimization information comprises a first set of fuel economy optimization information associated with uniform exhaust gas emissions surfaces for each of the plurality of engine operating modes and a second set of fuel economy optimization information associated with non-uniform exhaust gas emissions surfaces for at least one of the plurality of engine operating modes.

* * * * *